United States Patent [19]

Jaquay

[11] 4,199,352

[45] Apr. 22, 1980

[54] AUTOGENOUS PROCESS FOR CONVERSION OF METAL SULFIDE CONCENTRATES

[75] Inventor: Louis H. Jaquay, Pittsburgh, Pa.

[73] Assignee: Dravo Corporation, Pittsburgh, Pa.

[21] Appl. No.: 969,694

[22] Filed: Dec. 15, 1978

[51] Int. Cl.[2] ..... C22B 15/00

[52] U.S. Cl. ..... 75/74; 75/72; 75/76

[58] Field of Search ..... 75/74, 72, 76, 75

[56] References Cited

U.S. PATENT DOCUMENTS

| | | | |
|---|---|---|---|
| 3,627,510 | 12/1971 | Vogt et al. | 75/76 |
| 3,792,998 | 2/1974 | Norro | 75/74 |
| 3,941,587 | 3/1976 | Queneau et al. | 75/72 |
| 3,988,148 | 10/1976 | Queneau et al. | 75/74 |
| 4,010,030 | 3/1977 | French | 75/76 |

*Primary Examiner*—R. Dean

*Attorney, Agent, or Firm*—Parmelee, Miller, Welsh & Kratz

[57] ABSTRACT

A continuous, autogenous process for conversion of nonferrous metal sulfide concentrates to remove metal therefrom wherein oxygen-containing gas is fed to a molten concentrate charge, through fluid shielded nozzles of a substantially horizontal converter, wherein sulfur trioxide is fed along with the oxygen-containing gas, with the sulfur trioxide converted to sulfur dioxide within the converter to absorb heat from the charge and assist in control of the temperature thereof.

11 Claims, 1 Drawing Figure

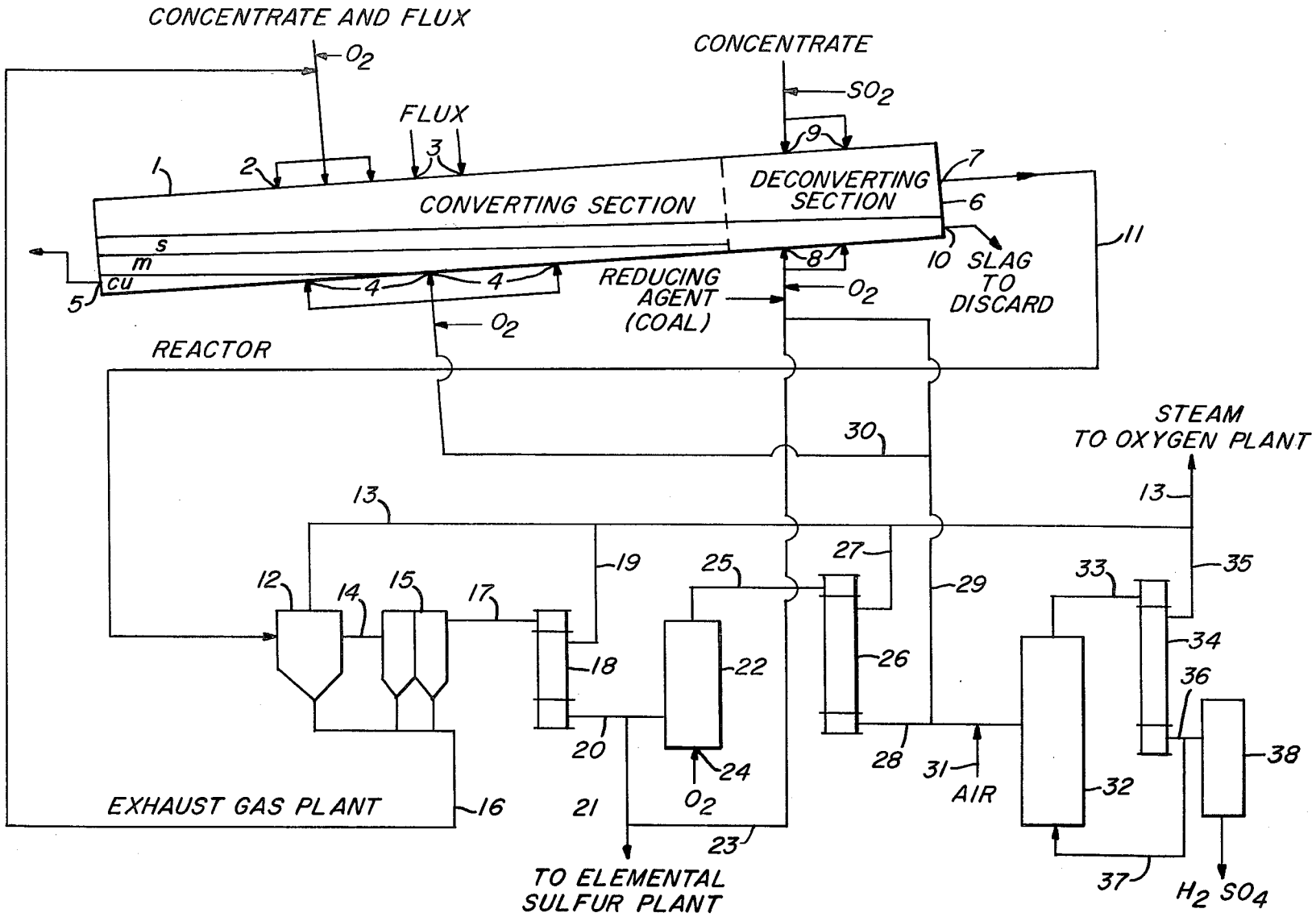
CONCENTRATE AND FLUX
$O_2$
FLUX
CONCENTRATE
$SO_2$
DECONVERTING SECTION
CONVERTING SECTION
REDUCING AGENT (COAL)
$O_2$
SLAG TO DISCARD
REACTOR
STEAM TO OXYGEN PLANT
AIR
$H_2SO_4$
TO ELEMENTAL SULFUR PLANT
EXHAUST GAS PLANT
s
m
cu

AUTOGENOUS PROCESS FOR CONVERSION OF METAL SULFIDE CONCENTRATES

BACKGROUND OF THE INVENTION

The present invention relates to the extraction of heavy nonferrous metals from their ores and, in particular, to a means of absorbing excess heat during the continuous, autogenous conversion of the sulfides of these metals.

In the process for continuous, autogenous conversion of nonferrous metal sulfides to recover the value metals therefrom, known as, and referred to hereinafter as, the "Q-S Oxygen Process," oxygen and a shielding fluid, heretofore generally being sulfur dioxide, are introduced into an elongated, rounded cross-section furnace at various locations. This process, especially useful in the conversion of copper sulfide concentrates to crude copper, combines much of the latest pyrometallurgical processing technology into a continuous copper making process. This process is generally described in U.S. Pat. No. 3,941,587 and U.S. Pat. No. 3,988,148, the contents of both patents being incorporated herein by reference.

One of the features of the Q-S Oxygen Process is the use of fluid shielded nozzles for injecting oxygen-containing gases into the molten charge. The use of a shielding fluid keeps the temperature of these nozzles at a permissible level so that sufficiently high concentrations of oxygen may be employed, and so that the process is autogenous, that is, not requiring external fuels for purposes of heat. The aforementioned patents also disclose that in addition to sulfur dioxide, hydrocarbons or water may be used as a shielding fluid.

It is found, furthermore, that in addition to merely shielding the nozzles of the oxygen injectors, it is necessary to remove heat from the entire system in general. That is, the iron and sulfur content of the typical ore concentrates which are produced by present day flotation processes and which are used as feed material in the Q-S Oxygen Process are sufficiently high so that the oxidation of these elements with the pure oxygen employed in the Q-S Oxygen Process will result in the generation of more heat than is consumed by the process. The result of the production of such excess heat is that the molten charge temperature rises to a level which may adversely affect the furnace refractories if heat were not removed from the system.

Several methods are known for the absorption and removal of this excess heat. For example, injection of a heat absorbing material such as nitrogen, water, copper scrap or recycled sulfur dioxide may be effected. These methods, however, have certain disadvantages. The use of nitrogen or water will tend to dilute the concentration of sulfur dioxide in the system's exhaust gas, thus making the recovery of some useful product from that sulfur dioxide more expensive. Specifically, if the exhausted sulfur dioxide is to be used to produce sulfuric acid, water vapor must be removed. If the exhausted sulfur dioxide is to be used to produce elemental sulfur, the presence of nitrogen would require the use of considerably more energy than if the same process were carried out on a sulfur dioxide stream containing little nitrogen. While the addition of copper scrap to the process for absorption of heat is a preferred method in that the off-gases are not diluted, such scrap is rarely available in sufficient quantity and in the physical condition that is required at a converter site.

The recycling of sulfur dioxide to the system also prevents dilution of the exhaust gas. The comparatively limited heat absorption capacity of sulfur dioxide, however, requires that it be injected into the reactor in such quantities that the volume of the exhaust gas, which includes the sulfur dioxide injected as a protective fluid as well as that generated in the process itself, may be disadvantageously large. That is, the subsequent removal of dust from the exhaust gas by means of a precipitator or equivalent means may be more efficiently accomplished where a given amount of dust is carried by a comparatively small rather than a large volume of exhaust gas. In the same way, the subsequent recovery of waste heat may also be facilitated where the volume of the exhaust gas is limited.

It is, then, an object of the present invention to provide a means whereby the nozzles employed for injecting oxygen directly into the molten charge in a Q-S Oxygen Process are shielded and in which the excess heat generated by that process is efficiently removed from the reactor, while at the same time limiting the volume of the exhaust gas which is produced by the process. A further object of the present invention is to provide a means for achieving such cooling in which the process exhaust gas is equally well suited for the production of either elemental sulfur or sulfuric acid. Still further objects and advantages of the present invention will be apparent from the following description.

SUMMARY OF THE INVENTION

The present invention is an improvement in a continuous, autogeneous process for recovering metal values from nonferrous metal sulfide concentrates wherein a molten bath comprising a metal rich phase and a slag phase is established and maintained beneath a sulfur dioxide containing gaseous phase in a sealed furnace, and wherein value metal-rich material, slag and sulfur dioxide containing off-gases are separately removed and wherein oxygen and a protective fluid are introduced directly into the molten bath. As is described in the above referenced U.S. Pat. No. 3,941,587 and U.S. Pat. No. 3,988,148, a commercial oxygen may be introduced in this process by means of injectors extending through a refractory lining and having openings communicating with the interior of the furnace beneath the surface of the liquid. The injector nozzles and refractory are protected during the introduction of oxygen into the molten metal, by injecting along with the oxygen, protective fluids either mixed with the oxygen or surrounding the oxygen streams. It is a feature of the present invention that the shielding fluid which is introduced in this manner is sulfur trioxide.

By using sulfur trioxide instead of sulfur dioxide, it is then possible, while injecting a smaller amount of protective fluid, to absorb sufficient heat so as to provide the same degree of protection for the oxygen injector nozzles and the refractory lining of the furnace. The volume of the furnace exhaust gas is, therefore, correspondingly reduced and the benefits attendant to such a reduction in exhaust gas are achieved. Further, the sulfur trioxide supplies, on decomposition, process oxygen equal to half its volume. It is also a feature of a preferred embodiment of the present invention that the sulfur trioxide is produced by the catalytic oxidation of the sulfur dioxide rich exhaust gas from the furnace. Another feature of this preferred embodiment is that elemental sulfur is produced from a portion of the sulfur dioxide in the exhaust gas before oxidation, while after oxidation a portion of the sulfur trioxide is used to produce sulfuric acid. A still further feature of this preferred embodiment is that high pressure steam is formed from the heat generated by the catalytic oxidation of the sulfur dioxide.

BRIEF DESCRIPTION OF THE DRAWING

The present invention is more fully explained in the accompanying drawing in which is shown a schematic view of a furnace in which the process is carried out and a block diagram of a plant for treating and recirculating exhaust gas from that furnace.

DETAILED DESCRIPTION

Referring to the accompanying figure, it may be seen that the process is carried out in an elongated, gently sloped, rounded cross-section sealed furnace 1 which serves as a trough for the molten bath. To briefly summarize the disclosures of the above referenced U.S. Pat. No. 3,941,587 and U.S. Pat. No. 3,988,148, with respect to this furnace and the process therein, when the process is in operation, the molten bath will layer out into a pool of a matte M, a slag S and a pool of crude copper C. Copper sulfide concentrates and oxygen are mixed and introduced in staged ratios through several inlets as at 2 and flux is introduced through inlets as at 3. Commercial oxygen is blown directly into the molten bath through several injectors as at 4. The nozzles of said injectors are protected by suitable shielding fluid which may be mixed with the oxygen or injected in a pattern surrounding the nozzles. It is a feature of the present invention that this shielding fluid is sulfur trioxide or a mixture of sulfur trioxide and sulfur dioxide.

It is known that the heat absorbing capacity of sulfur trioxide is approximately three times greater than an equal volume of sulfur dioxide. For example, the heat absorbed by a cubic foot of sulfur dioxide in raising its temperature from 77° F. to 2200° F. is 67 BTU. An equal amount of sulfur trioxide initially at 77° F. will absorb 109 BTU when it decomposes to sulfur dioxide and oxygen, a reaction that will occur completely at 2200° F. The heating of the resultant sulfur dioxide and oxygen to 2200° F. requires 88 BTU for a total of 197 BTU.

The staged injection of oxygen at 4 progressively oxidizes the matte as it flows toward the copper discharge end 5, with formation of increasingly copper-rich matte and finally crude copper. Simultaneously, the slag formed flows countercurrently toward the slag discharge end 6. The sulfur dioxide-rich gas evolved passes over the slag on its way to the gas outlet 7. The reactor is also capable of being oscillated about its longitudinal axis so as to allow the oxygen injected through the injectors 4 to enter the molten bath at continuously different angles to its surface so that it reaches constantly changing parts of the bath and results in turbulence of both chemical and physical origin. Furthermore, the oscillation of the reactor causes the concentrates and flux fed from inlets 2 and 3 to be fed from constantly changing positions with reference to the surface of the bath. Also, since the atmosphere above the bath is generally flowing towards the slag discharge end, the concentrates and flux fed are moving transversely to its flow, bringing about efficient conversion of the concentrates to create copper, low copper-containing slag and sulfur dioxide-rich gas.

In addition to the above described converting section of the reactor, there is also a deconverting section wherein scavenging of the slag and fixation of sulfur dioxide from the exhaust gas in the slag are effected. Through injectors 8 in the deconverting section, there is introduced below the surface of the slag S, coal, recirculated sulfur dioxide and oxygen. Iron sulfide concentrate may also be introduced in this section through inlets 9. The quantities of these substances are adjusted to cause the continuous formation, within the slag layer, of low grade matte which settles through the slag and cleans the value metal from the slag to a low level before the slag is discharged from the furnace at 10.

As described above, the volume of the gas that is added as a shielding fluid, when sulfur trioxide is used, may be significantly reduced while at the same time providing improved heat removal from the bath. In addition, the use of sulfur trioxide as the shiedling fluid, or as a mixture with the oxygen, with such sulfur trioxide introduced into the molten bath, results in production of oxygen and sulfur dioxide. The sulfur dioxide again acts as a coolant, while the oxygen produced is available for reaction with the bath materials to supplement the oxygen being charged to the furnace for reaction purposes. This would enable the use of a lesser amount of commercial oxygen in effecting conversion of the sulfides in the furnace.

The exhaust gas from outlet 7 which is high in sulfur dioxide content may then be conveyed by line 11 to waste heat boiler 12 in which steam may be generated and then carried to an oxygen plant (not shown) by line 13. Thereafter, the gaseous stream passes by means of line 14 to a precipitator 15 where dust particles are removed. Said dust may then be recycled by means of line 16 to the furnace at inlets 2. The gaseous stream is then conveyed by line 17 to heat exchanger 18 where additional steam may be generated and then removed by line 19 to line 13 to the oxygen plant. The exhaust gases which are recovered from the heat exchanger 18 may be expected to be more than ninety percent sulfur dioxide by volume, which amount is sufficient for production, without further enrichment, of elemental sulfur. Accordingly, the gaseous stream conveyed fom heat exchanger 18 by line 20 is divided with one stream being removed by line 21 to an elemental sulfur plant and another stream remaining in line 20 for conveyance to a catalytic oxidizer 22. A portion of the gaseous stream conveyed by line 21 is also removed by line 23 to the deconverting section of the furnace through injectors 8.

In the catalytic oxidizer 22, sulfur dioxide is catalytically combined with oxygen, added at inlet 24, in an exothermic reaction to produce sulfur trioxide. The off-gases from the catalytic oxidizer 22, which gases are predominately sulfur trioxide and some sulfur dioxide, are conveyed by line 25 to a heat exchanger 26 where steam may be produced, which steam is then conveyed by line 27 to line 13 also to the oxygen plant. The gaseous stream recovered from heat exchanger 26 is conveyed by line 28 to line 29, where a portion of that gaseous stream, which is still predominantly sulfur trioxide and some sulfur dioxide, is introduced through injectors 8 to the deconverting section as a protective fluid. A portion of this sulfur trioxide is also removed from line 29 and is, by line 30, conveyed to the converting section and is there introduced as a protective fluid through injectors 4. By employing sulfur trioxide as a protective fluid in this manner, it is possible, as was heretofore explained, to achieve the same protective effect as would be obtained by the use of a considerably larger amount of sulfur dioxide.

To the remainder of the gaseous stream in line 28, air is added at inlet 31 and that portion of the gaseous stream is conveyed to a catalytic oxidizer 32, where sulfur dioxide contained therein is oxidized to sulfur trioxide. The off-gases from said catalytic oxidizer 29, which gases are predominantly sulfur trioxide, nitrogen and oxygen, are conveyed to line 33 to heat exchanger 34 where steam is generated and conveyed by lines 35 to line 13 and thence to the oxygen plant. The gaseous stream recovered from heat exchanger 34 is conveyed by line 36 to line 37 with a portion of that stream being recycled to the catalytic oxidizer 32. The remainder of the stream in line 36 is further conveyed by said line to an absorption tower 38 where sulfuric acid is produced.

It is also noted that in addition to injecting sulfur trioxide as a protective fluid in the molten bath, it is possible to inject this fluid into both the bath and the gaseous phase. Sulfur trioxide may be added to the gaseous phase as, for example, at inlet 2.

I claim:

1. In a continuous, autogeneous process for recovering metal values from nonferrous metal sulfide concentrates wherein a molten bath comprising a metal rich phase and a slag phase is established and maintained beneath a sulfur dioxide containing gaseous phase in a sealed furnace and wherein value metal-rich material, slag and sulfur dioxide containing off-gases having dust entrained therein are separately removed and where oxygen and a protective fluid are introduced directly into the molten bath, the improvement wherein said protective fluid comprises sulfur trioxide such that subsequent removal of said dust from the off-gases is facilitated while contamination of said off-gases with fluids other than sulfur dioxide is minimized.

2. The process of claim 1 in which a gaseous mixture containing a major amount of sulfur trioxide is introduced as a protective fluid.

3. The process of claim 2 in which the sulfur trioxide is mixed with sulfur dioxide.

4. The process of claim 1 in which sulfur dioxide contained in the off-gases removed from the furnace is oxidized to sulfur trioxide and said resulting sulfur trioxide is introduced to the molten bath as the protective fluid.

5. The process of claim 4 in which the dust is removed from the off-gases removed from the furnace before sulfur dioxide contained in said off-gases is oxidized to sulfur trioxide and said dust is returned to said furnace.

6. The process of claim 4 in which heat is removed from the sulfur dioxide containing off-gases to generate steam.

7. The process of claim 4 in which steam is generated from heat produced by the oxidation of sulfur dioxide to sulfur trioxide.

8. The process of claim 4 in which at least a portion of said sulfur dioxide is removed for the production of elemental sulfur.

9. The process of claim 4 in which a portion of the resulting sulfur trioxide is removed, prior to introduction to the molten bath, and said sulfur trioxide is used for the production of sulfuric acid.

10. The process of claim 1 in which the sulfur trioxide is introduced into the gaseous phase in the furnace, as well as into the molten bath as a protective fluid.

11. The process of claim 4 in which the sulfur trioxide resulting from the oxidation of the sulfur dioxide contained in the off-gases is introduced into the gaseous phase in the furnace, as well as into the molten bath as a protective fluid.

* * * * *